US006351896B1

(12) United States Patent
Vainio

(10) Patent No.: US 6,351,896 B1
(45) Date of Patent: Mar. 5, 2002

(54) METHOD AND APPARATUS FOR DRYING A FIBER WEB

(75) Inventor: Veli-Matti Vainio, Tampere (FI)

(73) Assignee: Metso Paper, Inc., Helsinki (FI)

( * ) Notice: Subject to any disclaimer, the term of this patent is extended or adjusted under 35 U.S.C. 154(b) by 0 days.

(21) Appl. No.: 09/622,530

(22) PCT Filed: Feb. 17, 1999

(86) PCT No.: PCT/FI99/00128

§ 371 Date: Aug. 18, 2000

§ 102(e) Date: Aug. 18, 2000

(87) PCT Pub. No.: WO99/42655

PCT Pub. Date: Aug. 26, 1999

(30) Foreign Application Priority Data

Feb. 18, 1998 (FI) ..... 980374

(51) Int. Cl.[7] ..... F26B 7/00

(52) U.S. Cl. ..... 34/428; 34/393; 34/454; 34/71; 34/119; 34/124; 34/624; 162/207; 162/358.5; 162/359.1

(58) Field of Search ..... 34/392, 393, 398, 34/417, 418, 428, 429, 444, 454, 558, 65, 71, 95, 116, 119, 123, 124, 624; 162/206, 207, 358.3, 358.5, 359.1, 360.3, 375

(56) References Cited

U.S. PATENT DOCUMENTS 4,506,456 A * 3/1985 Lehtinen ..... 34/380
4,887,362 A 12/1989 Rautakorpi
4,899,461 A * 2/1990 Lehtinen ..... 34/392
4,932,139 A 6/1990 Lehtinen

OTHER PUBLICATIONS

PCT International Search Report, PCT/FI99/00128, Completed May 12, 1999.

* cited by examiner

*Primary Examiner*—Pamela Wilson
(74) *Attorney, Agent, or Firm*—Alston & Bird LLP

(57) ABSTRACT

A method and apparatus for drying a fiber web, in which the fiber web is dried between two tight bands moving in the same direction and turning around turning rolls. The first band is heated and the second band is cooled by a cooling chamber. The cooling chamber includes at least one cooling element and the cooling element includes at least one inlet chamber and at least one outlet chamber. The fiber web is arranged to run through a drying zone, with at least one felt or wire, such that the fiber web is in contact with the surface of the first, heated band and the felt or wire is between the fiber web and the second, cooled band. The pressure of the cooling element is balanced by a pressure balancing means, and the second band is provided with a hydraulic bearing for allowing the band to slide evenly and with little friction on the cooling chamber.

23 Claims, 2 Drawing Sheets

METHOD AND APPARATUS FOR DRYING A FIBER WEB

FIELD OF THE INVENTION

Figure 1:
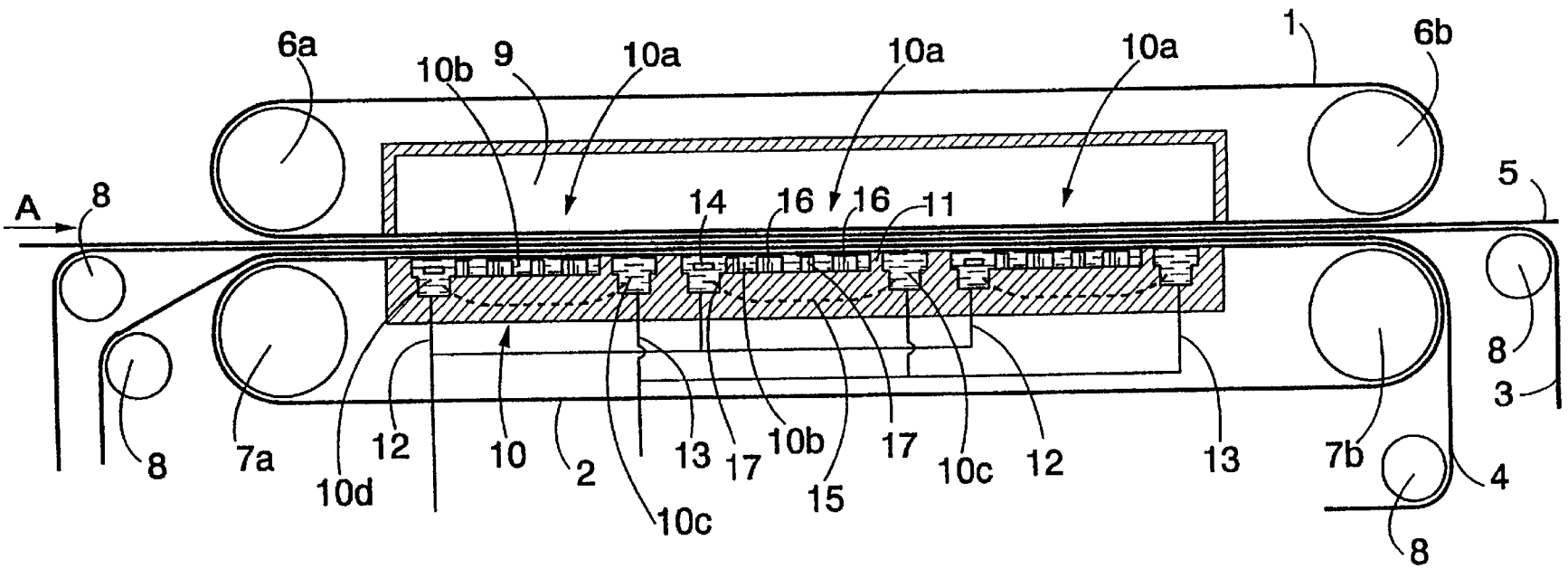

The invention relates to a method of drying a fiber web by an apparatus comprising two endless bands that are impermeable to air; first turning rolls, around which the first band is arranged to turn; and second turning rolls, around which the second band is arranged to turn; the first band and the second band being arranged to run part of the way in parallel such that they define a drying zone between them; the first band being heated and the second band being cooled by a cooling chamber; and the fiber web and at least one felt or wire being arranged to run between the bands so that the fiber web is in contact with the first, heated band and that the felt or wire is between the fiber web and the second, cooled band.

The invention also relates to an apparatus for drying a fiber web, the apparatus comprising two endless bands that are impermeable to air; first turning rolls, around which the first band is arranged to turn; and second turning rolls, around which the second band is arranged to turn; the first band and the second band being arranged to run part of the way in parallel such that they define a drying zone between them; the first band being arranged to be heated by heating means and the second band being arranged to be cooled by a cooling chamber; the fiber web and at least one felt or wire being arranged to run between the bands so that the fiber web is in contact with the first, heated band and that the felt or wire is between the fiber web and the second, cooled band.

BACKGROUND OF THE INVENTION

Many patent publications, such as WO 96/11300 and U.S. Pat. No. 4,461,095, teach the drying of a fiber web between two parallel metal bands moving in the same direction such that the fiber web is in contact with the heated metal band and that there is a wire between the fiber web and the second, cooled metal band, whereby the steam separated from the fiber web by heating condenses to the wire by the effect of the cold metal band. The basic idea is that two endless metal bands are arranged to turn around turning rolls and that against the inner surface of the loops formed by the bands are provided pressure chambers containing hot steam and water, respectively, such that the pressure produced presses the hot and cold bands, respectively, against the fiber web and the wire running between them. The bands located between the pressure chambers define one side of the pressure chambers by means of seals, whereby the steam and the water can directly affect the bands. The operation of the apparatus is fully known per se and has been disclosed, for example, in the above patent publications, which are incorporated herein by reference.

Finnish Patent 76 856 discloses a similar solution as described above: the web to be dried is transferred on a felt between endless bands running around. The band in contact with the web is heated by a steam chamber and the band in contact with the felt is supported and cooled by support and cooling means at the steam chamber. A hydrostatic plate is used as the support and cooling means, the hydrostatic plate having several adjacent pressure pockets and return channels separated from one another by means of ridges. Water is supplied to the pressure pockets so that it discharges over the ridges into the return channels. The solution works superbly, but as the speed of the paper machines grows, the solution of controlling the friction and the pressure on the water table needs to be improved.

The object of the present invention is to provide a method and an apparatus for quick and efficient drying of a fiber web.

SUMMARY OF THE INVENTION

The method of the invention is characterized in that the cooling chamber comprises at least one cooling element, which in turn comprises at least one inlet chamber and at least one outlet chamber; that the pressure of the cooling element is balanced by pressure balancing means; and that the second band is provided with a bearing at the cooling element.

The apparatus of the invention is characterized in that the cooling chamber comprises at least one cooling element, which in turn comprises at least one inlet chamber and at least one outlet chamber, and that the cooling element also comprises at least one bearing and pressure balancing means.

The essential idea of the invention is that the fiber web is dried between the heated and the cooled band by cooling the band by cooling means that comprise at least one cooling element. The cooling element comprises at least one inlet chamber and at least one outlet chamber. A cooling medium is supplied via the inlet chamber to the cooling element, from which it passes over a ridge formed by the walls of the outlet chamber to the outlet chamber, and is subsequently discharged therefrom. The pressure of the cooling element is balanced by the pressure balancing means. In a preferred embodiment, the pressure is balanced by supplying the cooling medium along pressure balancing pipes from the end of the cooling element toward the beginning, seen in the travel direction of the cooled band. In another preferred embodiment, the cooling element comprises slide shoes, which provide hydrodynamic bearings for the cooled band with the help of the cooling medium. In a third preferred embodiment, support pins are arranged in the cooling element for the cooled band.

The advantage of the invention is that the balancing of the pressure in the cooling element prevents the cooling medium from passing toward the end of the apparatus and from being discharged from the apparatus at the seal of the rear end. Since the pressure does not vary, the cooled band and the bearing of the band can also be better controlled. On account of the slide shoes that provide the hydrodynamic bearing, the providing of the cooled band with a bearing is extremely successful. The support pins prevent the occurrence of plastic changes in the bands.

BRIEF DESCRIPTION tOF THE FIGURE

Figure 2:
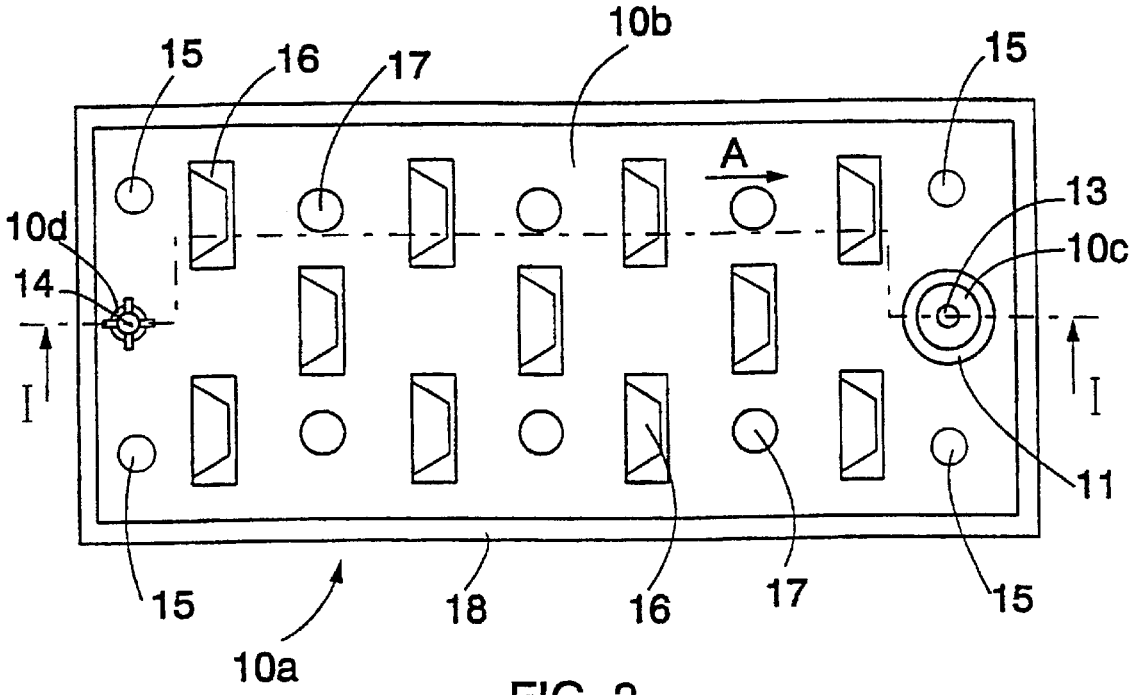
Figure 3:
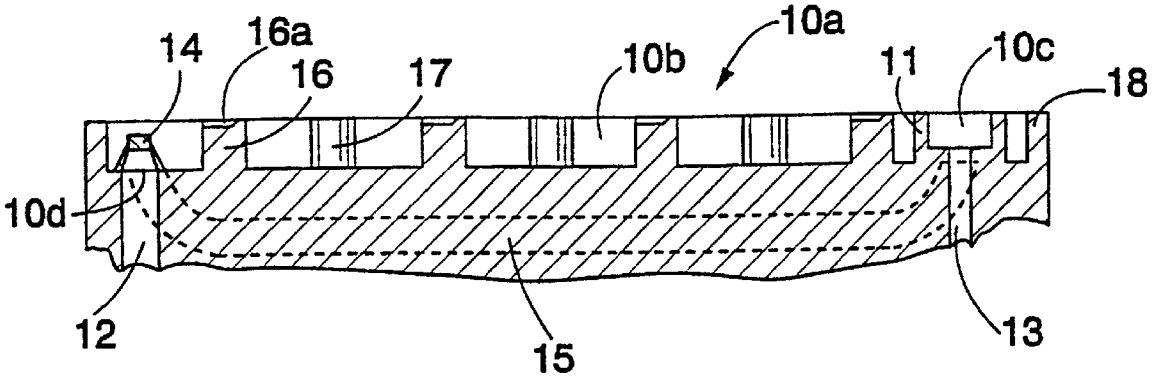

The invention will now be described in greater detail with reference to the attached drawing, in which FIG. 1 is a schematic sectional side view of an apparatus of the invention for drying a fiber web, taken in the travel direction of the web, FIG. 2 is a schematic top view of a cooling element in the apparatus of the invention, and FIG. 3 is cross-sectional side view of the cooling element of FIG. 2, taken along line I—I.

DETAILED DESCRIPTION OF THE PREFERRED EMBODIMENTS

FIG. 1 is a schematic sectional side view of an apparatus of the invention in the travel direction of the web. The apparatus comprises a drying apparatus comprising a first band 1, or an upper band, and a second band 2, or a lower band, that are endless, impermeable to air, have good thermal conductivity, and are preferably made of metal. A fine wire or felt 3, a coarse wire 4 and a fiber web 5 travel between those surfaces of the bands that face each other. The fiber web 5 moves in the direction indicated by arrow A. The first band 1 is arranged to turn around first turning rolls 6*a* and 6*b* located at the ends of the drying apparatus. The second band 2, in turn, is arranged to turn around second turning rolls 7*a* and 7*b* located below the first turning rolls 6*a* and 6*b* likewise at the ends of the drying apparatus. Wires 3 and 4 are supported and guided with guide rolls 8. Since the pressure prevailing in the drying zone between bands 1 and 2 is usually different from the pressure prevailing outside or laterally on the sides of the bands 1 and 2, seals are arranged on both sides of the apparatus between the bands 1 and 2 or close to the edges of the bands, the seals preventing the liquid or vapor from escaping laterally from the space between the bands 1 and 2 through the sides or vice versa. To effect the vapor heating required by the drying process, the drying apparatus comprises a pressure chamber 9 above the first band 1. The first band 1 is sealed in respect of the body of the pressure chamber 9 so that the steam in the pressure chamber 9 is maintained at a suitable pressure. Below the second band 2 there is a cooling chamber 10, which comprises water cooling the second band 2. The edges of the cooling chamber 10 are provided with seals, with which the second band 2 is sealed in respect of the body of the cooling chamber 10.

The operation of the drying apparatus is based on heating the first band 1, which comes into contact with the web 5, with hot steam contained in the pressure chamber 9, whereby the water in the web 5 is vaporized and transferred through the wires 3 and 4 toward the second band 2 by the effect of the temperature of the first band 1. The second band 2, in turn, is continuously cooled with the water located below it, whereby the steam produced on the surface thereof condenses into water and is removed with the band 2 and the wire 4.

The cooling chamber 10 comprises one or more cooling elements 10*a*. Water is supplied to an inlet chamber 10*b* of the element via an inlet opening 10*d* along inlet channels 12. In conjunction with each cooling element 10*a* is arranged an outlet chamber 10*c*, from which the water is removed along outlet channels 13. When water is supplied to the inlet chamber 10*b*, the water lifts the band 2. When the water pressure in the inlet chamber 10*b* is sufficiently high, the water can flow between the wall 11 of the outlet chamber 10*c* and the band 2 to the outlet chamber 10*c*. The water pressure of the inlet chamber 10*b* thereby stops rising, while the flow supplied along the inlet channel 12 is maintained constant. If the steam pressure in the pressure chamber 9 is raised, the band 2 presses down toward the outlet chamber 10*c*. This adds to throttle, and the pressure in the inlet chamber 10*b* rises, while the flow supplied to the inlet chamber 10*b* is maintained constant. The band 2 and the outlet chamber 10*c* thereby form a pressure regulator. The water is discharged along the outlet channels 13 to an essentially non-pressurized space. If necessary, water can also be sucked through the outlet channels 13.

The cooling element 10*a* regulates its own operation so that the pressure difference between the steam side and the water side remains essentially zero during all operation, even when the system is being driven up. The regulation is reliable, and it is also quick to respond to pressure changes. The number of outlet chambers 10*c* and the maximum capacity of the pump pumping water along the inlet channel 12 are designed so that when the steam pressure is zero, the band rises very little upward, for example about one millimeter, whereby the band 2 cannot rise to inside the pressure chamber 9. The machine can thereby be driven up by driving the bands simultaneously as the steam pressure is raised. The bands 1 and 2 do not buckle, which is what may happen if the pressure is raised while the bands are immobile, and the motors can also be smaller, since they do not have to overcome high initial friction. Also, the bands 1 and 2 are easy to control.

Guides 14 are arranged above the inlet openings 10*d* of the inlet channels 12 to guide the water to flow toward the sides in the inlet chamber 10*b* so that the dynamic power of the flow will not raise the band 2.

The cooling element 10*a* is also provided with pressure balancing channels 15, indicated by a broken line in FIGS. 1 and 3, inside the body of the cooling chamber 10. The water flows along the channels from the end of the cooling element 10*a* toward the beginning, seen in the travel direction of the band. The water pressure inside the cooling element 10*a* does thereby not rise too high at any point of the cooling element 10*a*, and so the band 2 and the pressure in the cooling chamber 10 are easy to control.

The cooling element 10*a* is also provided with support means, such as slide shoes 16 and/or support pins 17, to support the band 2.

The cooling chamber 10 can have one or more cooling elements 10*a*, whereby the pressure can be balanced within the cooling chamber 10. The rear wall of the cooling element 10*a* in the travel direction of the band 2 can be, for example, partly a water-scraping wall, whereby it prevents a billow from being conveyed with the band 2 toward the end of the cooling chamber 10 to the outlet end of the bands.

FIG. 2 shows a top view of a cooling element 10*a*. In FIG. 2, the band 2 can be cooled with one or more (e.g. twenty) successive and one or more (e.g. ten) parallel cooling elements 10*a*. A single cooling element 10*a* can also have several water supply points, i.e. inlet openings 10*d*, and one or more outlet chambers 10*c*. Preferably, however, the area of the inlet chamber 10*b* of the cooling element 10*a* is larger than the area of the outlet chamber or chambers 10*c* of the cooling element 10*a*, whereby the pressure regulator consisting of the band 2 and the walls 11 of the outlet chambers 10*c* functions best. If there are several cooling elements 10*a* in succession and/or in parallel, water can flow over the walls 18 of the cooling element 10*a* to the adjacent cooling element 10*a*. The outermost walls 18 of the outermost cooling elements 10*a* are naturally sealed against the band 2 in a manner known per se, so that essentially no water can escape from the cooling chamber 10. Arrow A in FIG. 2 indicates the travel direction of the band 2.

Water is supplied to the inlet chamber 10*b* through the inlet opening 10*d*. The guide 14 prevents the water from hitting the band 2 at high pressure, i.e. the guide 14 redirects the water flow.

The cooling element 10*a* comprises slide shoes 16, which provide a hydrodynamic bearing with the help of the water as the band 2 moves, whereby the band 2 slides evenly and with little friction on the cooling chamber 10, even at a very high speed.

The cooling element 10*a* further comprises support pins 17, against which the band 2 can be supported, for example, if the pressure in the cooling chamber 10 drops too much in comparison with the pressure in the pressure chamber 9. The support pins 17 thereby prevent plastic changes in the band 2.

FIG. 3 shows a cross-section of a cooling element 10*a*. A pressure balancing channel 15 remaining behind the point of cross-section is indicated by a broken line in FIG. 3.

The upper part of the slide shoes 16 is formed such that the water moved by the band 2 pushes between the slide shoe 16 and the band 2, thereby producing pressure that lifts the band. The slide shoe 16 here acts as a hydrodynamic bearing. FIG. 3 shows an example of how the upper part of the slide shoe 16 can be shaped: a cavity 16*a* is here provided in the upper part of the slide shoe.

The drawing and the accompanying description are intended only to illustrate the idea of the invention. The details of the invention may vary within the scope of the claims. It is thus not essential what pressure medium is used in the pressure chamber 9 and what cooling medium in the cooling chamber 10. The pressure medium in the pressure chamber 9 can thus be, for example, steam, air, hot fuel combustion products or water. The cooling medium in the cooling chamber 10 can be, for example, air, as well as water.

In addition to the heating by the pressure chamber 9, the first band 1 can also be heated at other places in manners known per se. Further, the first band 1 can also be heated entirely outside the pressure chamber 9, or the fiber web 5 can be dried even without the pressure chamber 9. Further, the second band 2 can also be cooled outside the cooling chamber 10.

The flow of water in the inlet channel 12, i.e. the output of the water pump producing the flow, and the pressure or suction of the outlet channel 13 can be controlled, for example, as a function of the steam pressure of the pressure chamber 9.

What is claimed is:

1. An apparatus for drying a fiber web, the apparatus comprising:

first and second endless bands that are impermeable to air;

first turning rolls around which the first band is arranged to turn;

at least one heater for heating the first band;

second turning rolls around which the second band is arranged to turn, the first band and the second band being arranged to run part of the way in parallel such that they define a drying zone between them;

at least one felt or wire being arranged to run between the bands with the fiber web so that the fiber web is in contact with the first band and the felt or wire is between the fiber web and the second band; and a cooling chamber for supplying a cooling medium to cool the second band, said cooling chamber comprising at least one cooling element having:

at least one inlet chamber, at least one outlet chamber, and pressure balancing means for balancing the pressure between one portion of the inlet chamber and another portion of the inlet chamber so that the pressure within the inlet chamber is balanced as the second band is advanced along the inlet chamber.

2. An apparatus as claimed in claim 1 wherein said pressure balancing means further comprises a pressure balancing pipe along which the cooling medium in the cooling chamber can flow from a downstream end of the inlet chamber of the cooling element to an upstream end of the inlet chamber of the cooling element.

3. An apparatus as claimed in claim 1 wherein the cooling chamber comprises a plurality of cooling elements.

4. An apparatus as claimed in claim 1 wherein the cooling element comprises support members for supporting the second band.

5. An apparatus as claimed in claim 1 wherein the cooling element is provided with at least one hydrodynamic bearing for providing the second band with a bearing.

6. An apparatus as claimed in claim 5 wherein the hydrodynamic bearing is a slide shoe.

7. An apparatus as claimed in claim 1 wherein the cooling medium is arranged to flow from the inlet chamber to the outlet chamber such that the outlet chamber and the second band together form a pressure regulator.

8. An apparatus as claimed in claim 1 wherein the pressure balancing means are substantially entirely located in the cooling chamber.

9. A cooling chamber of an apparatus having opposed heated and cooled bands for drying a fiber web, said cooling chamber comprising at least one cooling element having:

a cooling medium for cooling the cooled band;

at least one inlet chamber for the cooling medium;

at least one outlet chamber for the cooling medium; and pressure balancing means for balancing the pressure between one portion of the inlet chamber and another portion of the inlet chamber so that the pressure is balanced within the inlet chamber.

10. A cooling chamber as claimed in claim 9 wherein said pressure balancing means further comprises a pressure balancing pipe along which the cooling medium can flow from a downstream end of the inlet chamber of the cooling element to an upstream end of the inlet chamber of the cooling element.

11. A cooling chamber as claimed in claim 9 wherein the cooling chamber comprises a plurality of cooling elements.

12. A cooling chamber as claimed in claim 9 wherein the cooling element comprises support members for supporting the cooled band.

13. A cooling chamber as claimed in claim 9 wherein the cooling element is provided with at least one hydrodynamic bearing for providing the cooled band with a bearing.

14. A cooling chamber as claimed in claim 13 wherein the hydrodynamic bearings is a slide shoe.

15. A cooling chamber as claimed in claim 9 wherein the cooling medium is arranged to flow from the inlet chamber to the outlet chamber such that the outlet chamber and the cooled band together form a pressure regulator.

16. A method of drying a fiber web comprising the steps of:

advancing first and second endless impermeable bands to run at least partly adjacent and parallel to each other to thereby define a drying zone therebetween;

supporting the fiber web on at least one felt or wire;

advancing the felt or wire through the drying zone between the endless bands;

heating the first endless band;

cooling the second endless band with a cooling medium supplied to an inlet chamber of a cooling element; and balancing the pressure of the cooling medium between one portion of the inlet chamber and another portion of the inlet chamber.

17. A method as defined in claim 16 wherein said balancing step further comprises balancing the pressure of the cooling medium with a pressure balancing pipe extending between a downstream end of the inlet chamber and an upstream end of the inlet chamber.

18. A method as claimed in claim 16 wherein said cooling step further comprises cooling the second band with a plurality of cooling elements.

19. A method as claimed in claim 16 further comprising the step of supporting the second band with support members.

20. A method as claimed in claim 16 further comprising the step of bearing the second band on at least one hydrodynamic bearing.

21. A method as claimed in claim 20 wherein said bearing step further comprises bearing the second band on at least one slide shoe.

22. A method as claimed in claim 16 further comprising the step of regulating the pressure in the cooling element by the interaction of an outlet chamber and the second band as the cooling medium flows from the inlet chamber to the outlet chamber.

23. A method as claimed in claim 16 wherein the balancing step further comprises balancing the pressure with balancing means substantially entirely within the cooling element.

* * * * *

UNITED STATES PATENT AND TRADEMARK OFFICE

CERTIFICATE OF CORRECTION

PATENT NO. : 6,351,896
DATED : March 5, 2002
INVENTOR(S) : Vainio

It is certified that error appears in the above-identified patent and that said Letters Patent is hereby corrected as shown below:

Column 2,
Line 50, in the sub-heading "tOF" should read -- OF --.

Column 5,
Line 66, "clement" should read -- element --.

Signed and Sealed this

Twenty-first Day of May, 2002

*Attest:*

*Attesting Officer*

JAMES E. ROGAN
*Director of the United States Patent and Trademark Office*